US006854228B2

(12) United States Patent
Arseneau et al.

(10) Patent No.: US 6,854,228 B2
(45) Date of Patent: Feb. 15, 2005

(54) PREFABRICATED SEALED COMPOSITE INSULATING PANEL AND METHOD OF UTILIZING SAME TO INSULATE A BUILDING

(75) Inventors: Cyrille Arseneau, Bathurst (CA); Donald Fournier, Retit-Rocher (CA)

(73) Assignee: 602225 N. B. Inc., Miramichi (CA)

( * ) Notice: Subject to any disclaimer, the term of this patent is extended or adjusted under 35 U.S.C. 154(b) by 0 days.

(21) Appl. No.: 10/227,788

(22) Filed: Aug. 26, 2002

(65) Prior Publication Data

US 2002/0194805 A1 Dec. 26, 2002

Related U.S. Application Data

(63) Continuation of application No. 09/549,920, filed on Apr. 14, 2002, now abandoned.

(51) Int. Cl.[7] ..... E04C 1/00

(52) U.S. Cl. ..... 52/309.9; 52/309.8; 52/796.1; 52/428; 52/540; 52/591.4

(58) Field of Search ..... 52/309.8, 796.1, 52/428, 540, 591.4, 309.9

(56) References Cited

U.S. PATENT DOCUMENTS

| | | | | | |
|---|---|---|---|---|---|
| 274,354 | A | * | 3/1883 | Cumming | 52/591.4 |
| 726,506 | A | * | 4/1903 | Capen | 52/591.4 |
| 3,349,533 | A | * | 10/1967 | Gregoire | 52/716.8 |
| 3,736,715 | A | | 6/1973 | Krumwiede | |
| 3,785,913 | A | | 1/1974 | Hallamore | |
| 4,037,006 | A | | 7/1977 | Roberts et al. | |
| 4,147,004 | A | * | 4/1979 | Day et al. | 52/309.9 |
| 4,157,638 | A | * | 6/1979 | Della-Donna | 52/309.9 |
| 4,368,604 | A | * | 1/1983 | Spielau et al. | 52/309.8 |
| 4,418,507 | A | | 12/1983 | Roberts et al. | |
| 4,574,555 | A | | 3/1986 | Cline | |
| 4,628,650 | A | | 12/1986 | Parker | |
| 5,345,738 | A | | 9/1994 | Dimakis | |
| 5,349,796 | A | | 9/1994 | Meyerson | |
| 5,373,674 | A | | 12/1994 | Winter, IV | |
| 5,565,252 | A | | 10/1996 | Finestone et al. | |
| 5,735,098 | A | | 4/1998 | Kanai et al. | |
| 5,927,032 | A | * | 7/1999 | Record | 52/309.11 |
| 6,044,604 | A | * | 4/2000 | Clayton et al. | 52/309.9 |
| 6,177,180 | B1 | * | 1/2001 | Bodine et al. | 428/223 |
| 6,240,704 | B1 | * | 6/2001 | Porter | 52/794.1 |
| 6,256,931 | B1 | * | 7/2001 | Kenkel et al. | 49/450 |
| 6,287,678 | B1 | * | 9/2001 | Spengler | 428/297.4 |
| 6,470,632 | B1 | * | 10/2002 | Smith | 52/92.2 |

* cited by examiner

*Primary Examiner*—Carl D. Friedman
*Assistant Examiner*—Steve Varner
(74) *Attorney, Agent, or Firm*—McLane, Graf, Raulerson & Middleton, Professional Association

(57) ABSTRACT

A prefabricated sealed composite insulating panel for use in commercial and residential buildings. The panel has an insulating core sandwiched between an outer board layer and a skin material that is capable of radiating heat. The insulating core and the skin material are positioned so that they are offset with respect to the outer board layer such that the insulating core and the skin material extend beyond the outer board layer on one lateral side and on one transverse end. The insulating core and the skin material are recessed, with respect to the outer board by equivalent dimensions, on an opposite lateral side and on an opposite transverse end. The insulating core is completely surrounded and encapsulated by a plastic channel that protects the insulating core during transportation and installation. The composite panel, according to the present invention, provides a completely sealed panel that can be easily and efficiently installed on-site. Building structures can be efficiently insulated by installing these panels as exterior siding or interior finishing of a building.

26 Claims, 2 Drawing Sheets

FIG. 4
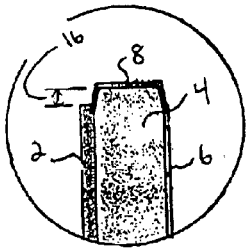
FIG. 2
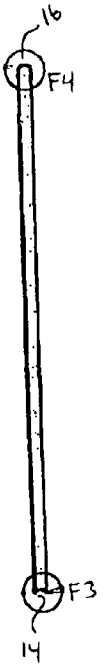
FIG. 5
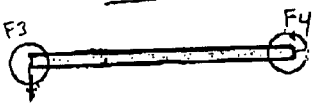
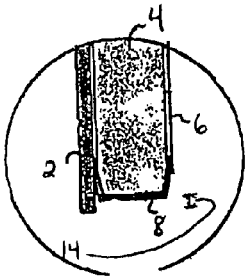
FIG. 3
FIG. 1
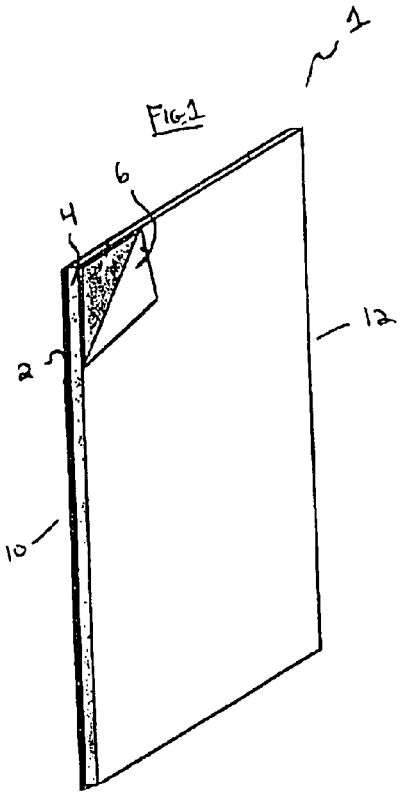

PREFABRICATED SEALED COMPOSITE INSULATING PANEL AND METHOD OF UTILIZING SAME TO INSULATE A BUILDING

CROSS-REFERENCE TO RELATED APPLICATION

This is a continuation of U.S. application Ser. No. 09/549,920, filed Apr. 14, 2002, now abandoned. Said application Ser. No. 09/549,920 is incorporated herein by reference in its entirety.

The present invention relates to insulated building panels and, in particular, to prefabricated panels to be used for both exterior and interior siding or walls for commercial and residential buildings.

BACKGROUND OF THE INVENTION

Construction of conventional structures, including both residential and commercial buildings, typically employ frame construction followed by exterior siding and interior finishing. For example, a home may be built by first constructing a wood frame with load-bearing walls and floor and ceiling joists extending between the walls. Commercial structures often employ steel rather than wood frames.

Once the framing is complete, exterior siding is then added to the frame. Walls may then be insulated with conventional insulating material, such as fiberglass insulation, to prevent thermal transfer between the exterior and interior of the building. Interior wall finish, such as Sheetrock, is then added. The ceilings and floors, between the floor and ceiling joists, are also frequently insulated.

This conventional technique has several drawbacks. For one, the method of construction is inefficient in that it requires a number of discrete steps to complete the installation of insulated walls. The siding step must be followed by a separate insulating step. Of course, this requires additional labor, and labor that is more expensive because it must be performed at the job site. The quality of the insulating job is also dependent upon the quality of the workmanship at the site, and may be adversely affected by exposure to weather-related elements. Furthermore, because much of the work in constructing insulated walls in the conventional manner must be done on-site, adverse weather can lead to significant delays in the construction process.

Additionally, the insulation is conventionally applied between the individual studs of the frame walls. Because there is no insulation applied to the exterior of the stud members, thermal bridging occurs across the stud members. In other words, heat from the interior of a structure can bridge across the stud members and escape into a colder exterior environment.

Various prefabricated wall panel systems have been devised which overcome many of the drawbacks of the conventional construction technique described above. For instance, the U.S. Pat. No. 4,628,650 issued to Parker and U.S. Pat. No. 5,349,796 issued to Meyerson disclose prefabricated building panels comprising an inner insulating core sandwiched between two outer layers. These panels improve upon on-site construction of building walls, but still suffer drawbacks eliminated by the present invention. For instance, the insulating core of these panels is left exposed along its perimeter. This allows for damage to the core during both the shipping and installation stages. An exposed core may also be susceptible to deterioration due to thermal drift. Certain insulating materials, such as urethane foam, suffer from the phenomenon known in the art as thermal drift, which is caused by the infusion of air through the foam cells and the resulting dilution of the insulating gas contained inside. Compounded with the intrusion of air into the cells is a flow of insulating gas out of the cells. Exposed insulating cores are also susceptible to deterioration due to weather related effects or insect infestation. The present invention eliminates these drawbacks by including a plastic channel that completely encapsulates and seals the insulating core.

Furthermore, the prior art panels are not assembled such that the insulating core is recessed both on one lateral side and one transverse end from the outer board surface, and equivalently protruded from the board layer on the opposite lateral side and transverse end of the panel. Without an offset of the insulating core both on the lateral sides and transverse ends, the user cannot ensure a tight seal between panels adjacent to one another or above one another in multiple story projects. The current invention is assembled with an offset insulating core that allows for the panels to be installed snugly against one another to reduce thermal bridging and air leaks between the interior and exterior of the building structure.

SUMMARY OF THE INVENTION

The present invention is directed to a prefabricated insulated building panel with all components thermally fused together. The inner insulating core consists of expanded polyurethane, or a similar insulating material, positioned between a layer of kraft aluminum foil on one side and board layer of suitable material such as oriented strand board ("OSB"), plywood or gypsum board on the other side. The entire perimeter of the insulating core is encapsulated by a plastic U-shaped channel that is thermally fused to the perimeter of the insulating core. On one lateral side of the panel, the insulating core protrudes a marginal amount, e.g., one-half inch or so, beyond the board layer. On the other lateral side, the insulating core is recessed an equivalent marginal amount, e.g., one-half inch or so, from the edge of the board layer. This offsetting protrusion and recession of the insulating core on the lateral sides facilitates proper positioning of adjacent panels during the installation process, and provides an overlap of adjacent panels that reduces thermal bridging and air leaks between the exterior and interior of a structure.

The same offsetting protrusion and recession of the insulating core exists on the transverse ends of the panel. This likewise facilitates proper positioning of panels above and below one another, for purposes of multi-story buildings. The overlap between the transverse ends of the adjacent panels also reduces thermal bridging and air leaks at junctions of the stories of a building.

OBJECTS OF THE INVENTION

Wherefore, it is an object of the present invention to overcome the above noted drawbacks associated with conventional building techniques as well as prior prefabricated panels.

One object of the invention is to provide a prefabricated, insulated building panel that can be quickly and efficiently installed on-site with little on-site labor.

Another object of the invention is to provide a thermally fused panel completely free of glues or solvents that are detrimental to the environment. A thermally fused panel also provides a more stable panel with greater endurance.

Yet a further object of the present invention is to provide a panel with an insulating core that protrudes on one lateral side and one transverse end and is equivalently recessed on the other lateral side and transverse end. This offsetting protrusion and recess on opposite sides and ends facilitates precise positioning of adjacent panels both side by side and above and below one another. It also significantly reduces thermal bridging and air leaks that can occur between adjacent panels.

Another object of the invention is to provide a panel that serves not only to insulate but also to serve as a vapor barrier and heat reflector.

Another object of the invention is to provide an insulating core that is completely surrounded by a plastic channel. The plastic channel protects the insulating core from deterioration due to thermal drift, weather-related effects, and insect infestation. The perimeter channel also adds a protective layer that shields against damage to the insulating core during shipping, storage and installation.

Yet another object of the invention is to provide prefabricated insulating panels that can be used for both exterior siding and interior finishing applications.

Other objects and advantages of this invention will become apparent from the following description taken in conjunction with the accompanying drawings which set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a diagrammatic perspective view of a composite panel embodying the present invention;

FIG. 2 is a diagrammatic left side elevational view of the composite panel of FIG. 1;

FIG. 3 is a diagrammatic exploded view, of a lower portion of the composite panel of FIG. 2 and a left end portion of FIG. 5, illustrating the recess of the insulating core relative to the board layer;

FIG. 4 is a diagrammatic exploded view, of a top portion of the composite panel of FIG. 2 and a right end portion of the FIG. 5, illustrating the protrusion of the insulating relative to the board layer;

FIG. 5 is a diagrammatic side view of an entire composite panel according to the present invention;

DESCRIPTION OF THE PREFERRED EMBODIMENTS

Figure 7:
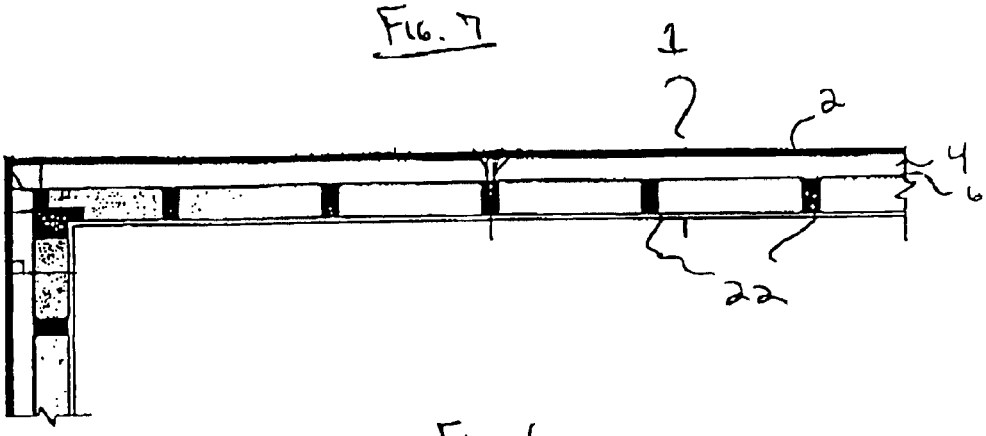
FIG. 7 is a diagrammatic perspective top view illustrating a building frame with attached composite panels according to the present invention.

Referring to first to FIG. 1, a sealed insulating composite panel 1 according to the present invention is shown. The composite panel 1 generally comprises an outer board layer 2 thermally fused to first surface of an inner insulating core 4, for example, expanded polyurethane. The opposite surface of the insulating core 4 is thermally fused to a layer of aluminum foil 6. The composite panel 1 may be manufactured in any dimensions, although preferably in dimensions that will suit typical building construction dimensions. For instance, it is preferred that the composite panel 1 be 4 feet by 8 feet or 4 feet by 9 feet as such dimensions are common and typical for the construction industry. A panel 1 measuring 4 feet by 9 feet may be used to not only provide insulation to the length of a wall, but also to insulate the floor of each story of a building, thereby preventing thermal bridging across floor members. The thickness dimension of the composite panel is typically between about 2 inches to about 6 inches or so and preferably between about 2 inches to about 4 inches.

The board layer 2 can be made of various materials depending upon the intended application of the panel. For example, oriented strand board ("OSB") provides excellent vertical strength at a reasonable cost. OSB is a preferable material when the composite panel 1 is to be used on the exterior of a structure's framing. Other potentially suitable materials include particle board, plywood or other conventional materials. The thickness of the board layer 2 can vary as needed depending upon the application, but conventional thicknesses such as ½ of an inch, 7/16 of an inch or ¾ of an inch generally meet typical strength and cost requirements. When the panel 1 is to be used for exterior siding of a structure, most preferably the panel 1 has board layer 2 made of OSB with a thickness of 7/16 of an inch.

If the composite panel 1 is to be used on interior surfaces, such as the interior wall of a below-grade foundation, gypsum board, or common Sheetrock board can be used as the board layer 2. A composite panel 1 comprising a board layer 2 made of gypsum board can be attached to the interior of a concrete foundation by conventional means, such that the aluminum foil 6 is positioned toward the foundation and the board layer 2 faces the interior of the structure. For instance, the panel 1 can be attached to the interior of a concrete foundation by utilizing conventional strapping. The panel would be attached to the strapping such that the aluminum foil 6 face of the panel is facing the strapping. When the panel 1 is to be used as an interior surface of a structure, most preferably the panel has a board layer 2 made of gypsum board with a thickness of ½ inch.

Regardless of the type of material used as the board layer 2, an inwardly facing surface of the board layer 2 is thermally fused to a core insulating layer of polyurethane 4. Such fusing, rather than employing glue or adhesive solvents, provides a more environmentally friendly product. Furthermore, the thermally fused composite panel 1 is not susceptible to deterioration due to degradation of any glue or adhesive solvent. It is to be appreciated that the thickness of the polyurethane insulating core 4 can vary according to construction needs, but a thickness of between one and three inches generally provides an adequate insulating effect for buildings in most climate zones. More preferably, the insulating core 4 is between two and two and one-half inches, and most preferably is two and one-eighth inches, which provides for an excellent insulating effect for buildings in most climate zones. The length and width dimensions of the insulating core 4 are equivalent to the length and width dimensions of the board layer 2, and those two components are fused together in an offset relationship described more fully below.

The insulating core 4 is sealed around its entire perimeter by a continuous plastic channel 8 (FIG. 4). The plastic channel 8 is thermally fused to the perimeter edge of the insulating core layer 4. One type of plastic material that performs well is a clear polyvinyl chloride ("PVC"). PVC fuses well to the polyurethane, and provides a protective layer around the perimeter of the insulating core 4. This protective channel 8 prevents damage to the insulating core 4 during shipping and handling as well as during installation of the composite panel 1. The protective channel 8 also protects against thermal drift of the insulating core 4 and against other deteriorative effects such as weather or insect infestation. If a clear plastic material is used as the protective channel 8, this also facilitates visual inspection of the finished condition and quality of the sealed insulating core 4 by construction personnel.

The plastic channel 8 must be wide enough to completely encapsulate the perimeter edge of the insulating core 4 to ensure an appropriate perimeter seal. Most preferably, the plastic channel is U-shaped to ensure complete encapsulation of the perimeter edge of the insulating core. The thickness of the plastic channel 8 depends on construction and cost considerations as well as the material used, but typically a plastic channel having a thickness between approximately 0.020 of an inch and 0.060 of an inch of PVC material provides sufficient strength and protection to the insulating core 4 made from polyurethane. Most preferably, the plastic channel 8 consists of a clear PVC material having a thickness of 0.032 of an inch.

As mentioned above, the surface of the insulating core 4, opposite of the surface fused to the board layer 2, is thermally fused to a thin layer of kraft aluminum foil 6 having a thickness of ⅛ inch or less and preferably 1/32 inch or less. The kraft aluminum foil 6 serves to radiate heat while also forming a vapor barrier which effectively seals the composite panel 1.

The insulating core 4 and the kraft aluminum foil 6 are both recessed with respect to the board layer 2 uniformly along one lateral side of the composite panel 1 (FIG. 3). The recess 10 in the insulating core 4 and the kraft aluminum foil 6, along one lateral side of the composite panel 1, is matched by an equivalent protrusion 12 of the insulating core layer 4 and the kraft aluminum foil 6, relative to the board layer 2, on the opposite parallel lateral side of the composite panel 1 (FIG. 4). This recess 10 and protrusion 12, on opposite lateral sides of the composite panel 1, facilitate positioning of the composite panel 1 in a side-by-side manner. The insulating core 4 and the kraft aluminum foil 6 are also recessed with respect to the board layer 2 uniformly along one transverse end of the composite panel 1 (FIG. 3). The recess 10 in the insulating core 4 and the kraft aluminum foil 6, along one transverse end of the composite panel 1, is matched by an equivalent protrusion 12 of the insulating core 4 and the kraft aluminum foil 6, relative to the board layer 2, on the opposite parallel transverse end of the composite panel 1 (FIG. 4). The recess 14 and protrusion 16 on the transverse ends allows for overlapping of adjacent panels above and below one another. This is beneficial when the panels 1 are to be installed in structures with more than one story. The offsetting recess 10 and protrusion 12, of the lateral sides and the transverse ends, causes an overlapped tight seal that can be reinforced with a sealant, such as conventional caulking material, to virtually eliminate any flow of fluid, e.g. air, heat, moisture, etc., therebetween.

The offsetting protrusion and recess of the insulating core 4 and the kraft aluminum foil 6, relative to the board layer 2, must be of sufficient length to ensure an adequate overlap of adjacent panels, but not so large as to jeopardize the stability of the panel 1. If the offsetting protrusion and recess are too small, the overlapping effect between two adjacent panels may not be sufficient enough to produce the intended sealing effect and may not facilitate the positioning and installation of adjacent panels. On the other hand, if the offsetting protrusion and recess are too great, the stability and integrity of the panel 1 may be diminished due to the extent of the exposure of the insulating core 4 on one lateral side and one transverse end of the panel 1. The protrusion of the insulating core 4 and the kraft aluminum foil 6 is preferably between one-fourth inch and one inch beyond the edge of the board layer 2, and most preferably approximately one-half inch beyond the edge of the board layer 2. Likewise, the recess of the insulating core 4 and the kraft aluminum foil 6 is preferably between one-fourth inch and one inch from the edge of the board layer 2, and most preferably approximately one-half inch from the edge of the board layer 2.

FIG. 2 illustrates, by way of a side view, the insulating core recess 14 on the bottom of the panel and an equivalent protrusion 16 of the insulating core 4 at the top of the panel 1. FIGS. 3 and 4 also illustrate a U-shaped plastic channel 8 thermally fused to the perimeter of the insulating core 4. FIG. 3 illustrates the insulating core recess 14 on the bottom of the panel, and FIG. 4 illustrates an equivalent protrusion 16 of the insulating core on the top of the panel.

Figure 6:
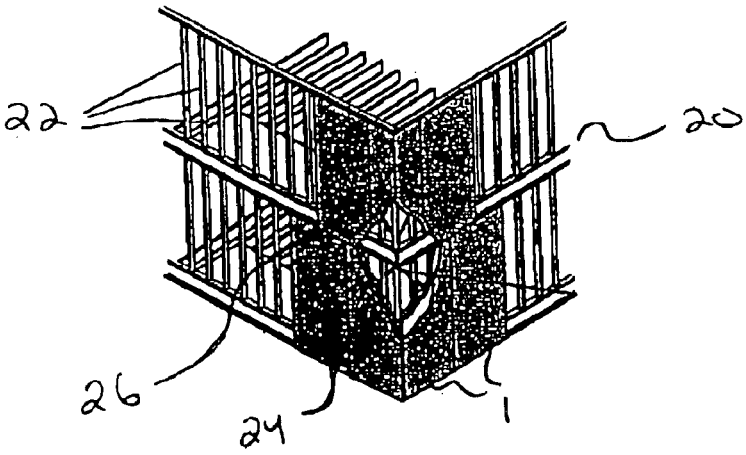
FIG. 6 is a diagrammatic partial perspective view of a building having two framed stories employing panels according to the present invention.

Without limitation on the general type of buildings for which the present invention may be used, FIG. 6 illustrates a plurality of panels 1 embodying the present invention applied to a building frame 20. The building frame 20 consists of a plurality of supporting studs 22. The composite panels 1 can be attached to the studs 22 using conventional fasteners or means such as nails, screws, etc. The nails, screws or other fasteners must be of sufficient length to penetrate through the composite panel 1 and sufficiently deep into the studs 22. In the most preferred embodiment of this invention, when used as exterior siding, the panel 1 comprises a board layer 2 having a thickness of 7/16 inch, an insulating core 4 having a thickness of two and one-eighth inches and a skin of kraft aluminum foil 6. A panel of these dimensions can be properly fastened to a structure frame using nails or screws having a length of approximately four inches.

The building depicted in FIG. 6 represents a multiple story building with composite panels 1 used for exterior siding on at least two stories. The offsetting insulating core recess and insulating core protrusion on the lateral sides on the composite panel 1 facilitates positioning of adjacent panels on the same story. The recessed insulating core of one panel's lateral side fits snugly 24 with the overlapped insulating core of the adjacent panels lateral side. Likewise, the insulating core recess on the transverse end of one panel fits snugly 26 against the extended insulating core on the panel position above or below an adjacent panel. In addition to facilitating placement of the panels, the offsetting insulating core recess and protrusion ensures a tight seal with reduced thermal bridging between the interior and exterior of the structure. The joints between two adjacent panels is typically sealed with a sealant such as conventional caulking.

As can be seen in FIG. 6, appropriately sized panels 1 may be used to insulate not only the length of walls, but also the floors of each story of a structure. This prevents thermal bridging across the floor members. For instance, a panel 1 having a length of 4 feet by 9 feet provides adequate length to cover the length of the walls and the floors members in many building structures.

FIG. 7 illustrates, by way of a perspective top view, the manner in which a composite panel 1 used for exterior siding is attached to a building frame. The composite panel 1 is positioned with the board layer 2 facing away from the building frame 20. The kraft aluminum foil 6 of the panel 1 is positioned directly against the studs 22 constituting the building frame 20. Each composite panel 1 is attached to the studs 22 of the building frame 20 by conventional fasteners such as nails or screws. Each composite panel 1 is attached to the outermost face of each stud 22 thereby covering the entire stud 22 with the insulated composite panel 1. This prevents thermal bridging across the studs. Because the exteriors of each stud 22 is covered by a composite panel 1, the studs 22 can be manufactured with less material, such as conventional metal or wood, because there is no thermal bridging across the studs.

Figure 8:
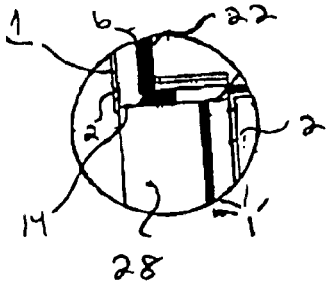
FIG. 8 is a diagrammatic enlarged view illustrating a composite panel used as exterior sheeting and a composite panel used as interior sheeting attached to the interior of a building foundation.

FIG. 8 illustrates how the composite panel 1, embodying this invention, can be used as exterior siding or for interior finishing of a building. FIG. 8 is an exploded view of a conventional concrete foundation 28 and a portion of the building frame 20 of the first story. A composite panel 1 is shown attached to the exterior of the frame 20 by conventional fasteners to the stud 22. The board layer 2 of the panel may consist of OSB, plywood or some other equivalent material that provides suitable strength and cost considerations for exterior siding material. The kraft aluminum foil 6 of the panel 1 radiates heat back inward toward the interior of the building, thereby reducing heat loss and, in conjunction with the insulating core, creates a vapor barrier. The insulating core recess 14, at the bottom of the composite panel 1, ensures a snug fit with the foundation 28, and the overlapping board layer provides a seal between the exterior wall and the foundation that reduces fluid flow therebetween, e.g. air leaks, heat loss, etc.

On the interior of the building foundation 28, a composite panel 1' may be employed to provide interior wall. The board layer 2 for the composite panel 1' may consist of gypsum board or some other equivalent material that is suitable for an interior finish such as Sheetrock, drywall, plasterboard, fiberboard, waferboard and wood panel. The composite panel 1' used for the interior finish can be attached to conventional strapping on concrete walls.

It is to be understood that certain changes may be made in the above described prefabricated composite panel without departing from the spirit and scope of the invention herein involved. Accordingly, it is intended that all of the subject mater of the above description or shown in the accompanying drawings shall be interpreted merely as examples illustrating the inventive concept herein and shall not be construed as limiting the invention.

We claim:

1. A prefabricated composite building panel comprising:

a rectangular core of insulating material having first and second opposed lateral sides defining a width dimension therebetween, first and second opposed transverse ends defining a length dimension therebetween, and opposed first and second surfaces defining a thickness dimension therebetween;

a rectangular board layer having first and second opposed lateral sides defining a width dimension therebetween, first and second opposed transverse ends defining a length dimension therebetween, and opposed first and second surfaces, and the width and length dimensions of the rectangular core of insulating material and the rectangular board being substantially identical to one another;

a plastic channel secured about and encapsulating a perimeter edge of the rectangular core of insulating material;

a skin attached to the second surface of the rectangular core of insulating material; and the second surface of said rectangular board layer being attached to the first surface of the rectangular core of insulating material such that a portion of the rectangular core of insulating material, on the first lateral side and on the first transverse end, being recessed with respect to the adjacent first lateral side and the adjacent first transverse end of the rectangular board layer, and a portion of the rectangular core of insulating material, on the second lateral side and on the second transverse end, protruding with respect to an adjacent second lateral side and an adjacent second transverse end of the rectangular board layer.

2. The building panel of claim 1, wherein the rectangular core of insulating material is polyurethane.

3. The building panel of claim 1, wherein the skin is paper-backed aluminum foil.

4. The building panel of claim 1, wherein said board layer is material selected from oriented strand board, particle board, plywood, plaster board, gypsum board, fiberboard, waferboard and wood panel.

5. The building panel of claim 1, wherein the second surface of the board layer is thermally fused to the first surface of the rectangular core of insulating material, and the skin is thermally fused to the first surface of the rectangular core of insulating material.

6. The building panel of claim 1, wherein said plastic channel is made of clear polyvinyl chloride.

7. The building panel of claim 1, wherein said plastic channel is attached to the rectangular core of insulating material by thermal fusion.

8. The building panel of claim 1, wherein the building panel has a length dimension of about 8 feet, a width dimension of about 4 feet and a thickness dimension of about 2 inches to about 6 inches.

9. The building panel of claim 1, wherein the building panel has a length dimension of about 9 feet, a width dimension of about 4 feet and a thickness dimension of about 2 inches to about 6 inches.

10. The building panel of claim 1, wherein the recess of the portion of the rectangular core of insulating material, on the first lateral side and on the first transverse end, with respect to the adjacent first lateral side and the adjacent first transverse end of the rectangular board layer is about one half of an inch and the protrusion of the portion of the rectangular core of insulating material, on the second lateral side and on the second transverse end, with respect to the adjacent second lateral side and the adjacent second transverse end of the rectangular board layer is about one half of an inch.

11. The building panel of claim 1, wherein the recess of the portion of the rectangular core of insulating material, on the first lateral side and on the first transverse end, with respect to and the adjacent first lateral side and the adjacent first transverse end of the rectangular board layer is at least one quarter of an inch and the protrusion of the portion of the rectangular core of insulating material, on the second lateral side and on the second transverse end, with respect to and the adjacent second lateral side and the adjacent second transverse end of the rectangular board layer is at least one quarter of an inch.

12. An insulated building structure, having at least one story, said structure comprising:

a load-bearing frame;

a plurality of prefabricated panels fastened to the load-bearing frame, each panel comprising a rectangular core of insulating material sandwiched between a skin and a board layer;

the rectangular core of insulating material having first and second opposed lateral sides defining a width dimension therebetween, first and second opposed transverse ends defining a length dimension therebetween, and opposed first and second surfaces defining a thickness dimension therebetween;

the rectangular board layer having first and second opposed lateral sides defining a width dimension therebetween, first and second opposed transverse ends defining a length dimension therebetween, and opposed first and second surfaces, and the width and length dimensions of the rectangular core of insulating material and the rectangular board being substantially identical to one another;

a plastic channel secured about and encapsulating a perimeter edge of the rectangular core of insulating material;

the skin being attached to the second surface of the rectangular core of insulating material; and the second surface of said rectangular board layer being attached to the first surface of the rectangular core of insulating material such that a portion of the rectangular core of insulating material, on the first lateral side and on the first transverse end, being recessed with respect to the adjacent first lateral side and the adjacent first transverse end of the rectangular board layer and a portion of the rectangular core of insulating material, on the second lateral side and on the second transverse end, protruding with respect to an adjacent second lateral side and an adjacent second transverse end of the rectangular board layer.

13. The insulated building structure of claim 12, wherein the rectangular core of insulating material of each prefabricated panel is polyurethane.

14. The insulated building structure of claim 12, wherein the skin of each prefabricated panel is paper-backed aluminum foil aluminum foil.

15. The insulated building structure of claim 12, wherein said board layer of each prefabricated panel material is selected from oriented strand board, particle board, plywood, plaster board, gypsum board, fiberboard, waferboard and wood panel.

16. The insulated building structure of claim 12, wherein said plastic channel is made of polyvinyl chloride.

17. A method for insulating the walls of a building structure having at least one story, said method comprising:

providing a building frame having a plurality of wall stud members, each stud member having an interior and exterior face;

providing a plurality of prefabricated panels, said panels having a rectangular core of insulating material sandwiched between a board layer and a skin of paper-backed aluminum foil such that the core of insulating material and the skin of paper-backed aluminum are recessed relative to the board layer on a first lateral side and a first transverse end of the panel, and such that the core of insulating material and the skin of paper-backed aluminum protrude relative to the board layer on a second lateral side and a second transverse end of the panel, said core of insulating material having a channel made of polyvinyl chloride secured to and encapsulating a perimeter edge of said core of insulating material;

fastening the prefabricated panels to the exterior faces of the wall stud members such that the board layer of the panel is directed away from the exterior faces of the wall stud members and such that the skin of paper-backed aluminum foil is directed toward the exterior faces of the wall stud members;

aligning panels adjacent to one another on each story of the building structure, prior to fastening the panels to the stud members, such that the first lateral side of a first adjacent panel is engaged with the second lateral side of a second adjacent panel, such that the recessed core of insulating material and recessed skin of paper-backed aluminum foil of the first lateral side of the first adjacent panel is overlapped by the protruded core of insulating material and protruded skin of kraft aluminum foil of the second lateral side of the second adjacent panel; and applying sealing material to the engaged lateral sides of laterally adjacent panels.

18. A method for insulating the walls of a building structure as in claim 17, further comprising:

aligning abutting panels on adjacent stories of the building structure, prior to fastening the panels to the stud members, to one another such that the first transverse end of a first abutting panel is engaged with the second transverse end of a second abutting panel, such that the recessed core of insulating material and recessed skin of kraft aluminum foil of the first transverse end of the first abutting panel is overlapped by the protruded core of insulating material and protruded skin of paper-backed aluminum foil of the second transverse end of the second abutting panel; and applying sealing material to the engaged transverse ends of abutting panels on adjacent stories.

19. An insulated sheet material subassembly for a building structure, comprising:

a generally rectangular sheet of board material;

an insulating panel generally conforming in size and shape to said sheet of board material and having a first face attached to a first face of said board material;

a vapor barrier covering a second face of said insulating panel opposite said first face of said insulating panel;

a plastic film sealing a peripheral edge of said insulating panel, said peripheral edge transverse to the first and second faces of said insulating panel; and said sheet of board material and said insulating panel being aligned in an offset relation relative to one another adapted to form an interlocking engagement between said sheet material subassembly and an adjacent like subassembly.

20. The insulated sheet material subassembly of claim 19, wherein the insulating panel is polyurethane.

21. The insulated sheet material subassembly of claim 19, wherein the vapor barrier is paper-backed aluminum foil.

22. The insulated sheet material subassembly of claim 19, wherein said board material is selected from oriented strand board, particle board, plywood, plaster board, gypsum board, fiberboard, waferboard and wood panel.

23. The insulated sheet material subassembly of claim 19, wherein the first face of the board material is thermally fused to the first face of the insulating panel, and the vapor barrier is thermally fused to the second face of the insulating panel.

24. The insulated sheet material subassembly of claim 19, wherein said plastic film is attached to the insulating panel by thermal fusion.

25. The insulated sheet material subassembly of claim 19, wherein the building panel has a size selected from:

a length dimension of about 8 feet, a width dimension of about 4 feet, and a thickness dimension of about 2 inches to about 6 inches; and a length dimension of about 9 feet, a width dimension of about 4 feet and a thickness dimension of about 2 inches to about 6 inches.

26. The insulated sheet material subassembly of claim 19, wherein the offset of the rectangular sheet of board material with relative to the insulating panel is in the range of from about 0.25 inches to about 0.5 inches.

* * * * *